US006467512B1

(12) United States Patent
Meyer et al.

(10) Patent No.: US 6,467,512 B1
(45) Date of Patent: Oct. 22, 2002

(54) METHOD FOR MONITORING THE CYCLE OF THE WEFT INSERTION INTO A WEAVING MACHINE

(75) Inventors: Urs Meyer, Niederglatt (CH); Ivan Castelli, Cantu (IT); Leonardo Fogu, Bizzarone (IT)

(73) Assignee: Iropa AG, Baar (CH)

( * ) Notice: Subject to any disclaimer, the term of this patent is extended or adjusted under 35 U.S.C. 154(b) by 0 days.

(21) Appl. No.: 09/937,368

(22) PCT Filed: Mar. 22, 2000

(86) PCT No.: PCT/EP00/02541

§ 371 (c)(1),
(2), (4) Date: Jan. 15, 2002

(87) PCT Pub. No.: WO00/56964

PCT Pub. Date: Sep. 28, 2000

(30) Foreign Application Priority Data

Mar. 22, 1999 (CH) ..... 541/99

(51) Int. Cl.[7] ..... D03D 47/30; D03D 47/32
(52) U.S. Cl. ..... 139/435.2; 139/194
(58) Field of Search ..... 139/435.2, 194, 139/55.1, 92, 82, 435.1

(56) References Cited

U.S. PATENT DOCUMENTS 3,688,958 A 9/1972 Rydborn
5,666,998 A * 9/1997 De Jager et al. ..... 139/194
6,105,627 A * 8/2000 Covelli ..... 139/194
6,328,081 B1 * 12/2001 Gotti et al. ..... 139/194

FOREIGN PATENT DOCUMENTS

EP 0117571 A1 9/1984

* cited by examiner

*Primary Examiner*—John J. Calvert
*Assistant Examiner*—Robert H. Muromoto, Jr.
(74) *Attorney, Agent, or Firm*—Flynn, Thiel, Boutell & Tanis, P.C.

(57) ABSTRACT

A method for monitoring the cycle of the weft insertion into a weaving machine. The weft yarn passes a yarn brake and a yarn force sensor and the force acting on the weft yarn is measured in a known fashion and the reaction force of the yarn is converted by a pressure sensitive element into an electrical signal. The electrical signal outputted by the yarn force sensor is electronically amplified in an evaluation unit, is evaluated and is transmitted to an indicator informing the operator of the development of the weft insertion and of disturbances and corrections. For this purpose, the evaluation unit is connected via a data line with a machine control unit. Evaluation unit is supplied with time signals from the machine control unit associated with further machine functions participating at the weft insertion, e.g. the momentary angular position of the main shaft of the machine. The machine control unit receives monitoring signals of the yarn force evaluation via the data line, e.g. for immediate stoppage in case of a yarn breakage occurring during the weft insertion, or to activate a machine related alarm system in case of a disturbance needing the interference by an operator.

9 Claims, 2 Drawing Sheets

METHOD FOR MONITORING THE CYCLE OF THE WEFT INSERTION INTO A WEAVING MACHINE

FIELD OF THE INVENTION

The invention relates to a method for monitoring the cycle of weft insertion into a weaving machine with a signal generating sensor activated by yarn deflection and connected to an evaluation unit.

BACKGROUND OF THE INVENTION

In known weaving machines, the cycle of the weft insertion is determined by a previously set program and is monitored by yarn feelers of mechanical, capacitive, triboelectrical or opto-electrical types. In order to assure a reliable response of said sensors to a yarn breakage the sensors have to react relatively slowly, i.e. by a response time with a magnitude 10 ms or more. From insertion to insertion in this way the cycle of the yarn movement during the weft insertion can be determined only vaguely by measuring the response points in time of different sensors provided along the yarn path. A continuous measuring and monitoring of the yarn movement during the weft insertion herewith is excluded. Also an optimization of the cycle of the weft insertion, e.g. by a target control of the air nozzles of the air jet weaving machine, is impossible in this case. Furthermore, it is difficult to detect problems of a weft insertion early enough. A reliable stop of the weaving machine in case of insertion disturbances, however, is a prerequisite so as to avoid fabric faults. For these reasons the existing sensors are frequently adjusted so sensitively that they stop the weaving machine even in a doubtful case. This leads to an increased demand for interferences by an operator.

According to the method as known from EP 0 117 571 A for monitoring the feeding state of a yarn during a weft insertion into a weaving machine, a tuning fork is actuated by the weft yarn which tuning fork during movement of the weft yarn transmits oscillations to a sensor provided e.g. with piezo-electric material. The movement of the weft yarn is detected and monitored in order to derive a signal exclusively indicating the running movement of the weft yarn. By means of a diagnosis, it is concluded that a yarn breakage has occurred from a yarn stop which occurs at a point in time which would not normally be expected. The yarn force resulting from the tension in weft yarn is not measured. Irrespective of the momentary weft yarn tension, the sensor does not generate a signal when the weft yarn has stopped.

According to the weft yarn monitoring method known from U.S. Pat. No. 3,688,958 A, the sensor provided only generates a signal if the weft yarn is running and even first if the weft yarn has reached a predetermined running speed. The frequency of yarn irregularities rubbing at the sensor during the yarn run is measured, but not the yarn force.

The pulling force in the weft yarn occasionally is measured for scientific purposes in an experimental manner. Sensors used for this purpose employ strain measuring strips forming mechanical-electrical transducers. The materials used limit the sensitivity, the capability to withstand overloads, and the limit frequency such that only carefully prepared laboratory measurements can be carried out for single insertion cycles and only on particularly robust yarns which can stand the additional load at the deflection points of the sensors. For an industrial production the measuring method cannot be used, and also cannot be used because of the limited life duration, the complicated handling, and the high costs of those experimental apparatus.

It is an object of the present invention to measure the yarn force during a weft insertion with a reasonably priced, robust, accurate and quick-reacting sensor, and to optimize and more reliably monitor the cycle of the weft insertion. The sensor is based on the principle of yarn deflection. The deflection angle amounts to less than 45°, preferably less than 30°. The limit frequency of the sensor is set above 1 kHz, and preferably above 5 kHz. The sensor preferably is realized with a piezo-resistive or piezoelectric crystal. For the piezo-resistive measuring principle e.g. a force sensor type PK 8870 made by the Honeywell Company is used. The sensor is employed in co-action with a direct voltage amplifier having a limit frequency of at least 1 kHz, and preferably more than 5 kHz. For carrying out the piezo-electric measuring principle e.g. a force sensor of the production program of the Kistler Company is employed, in co-action with a charge amplifier. In this case, a quasi static output signal is generated by respectively resetting the amplifier in the forceless phase of the insertion cycle. Details of the piezo-electrical measuring method are described in detail in the sales documentation of the Kistler Company.

DETAILED DESCRIPTION

Figure 1:
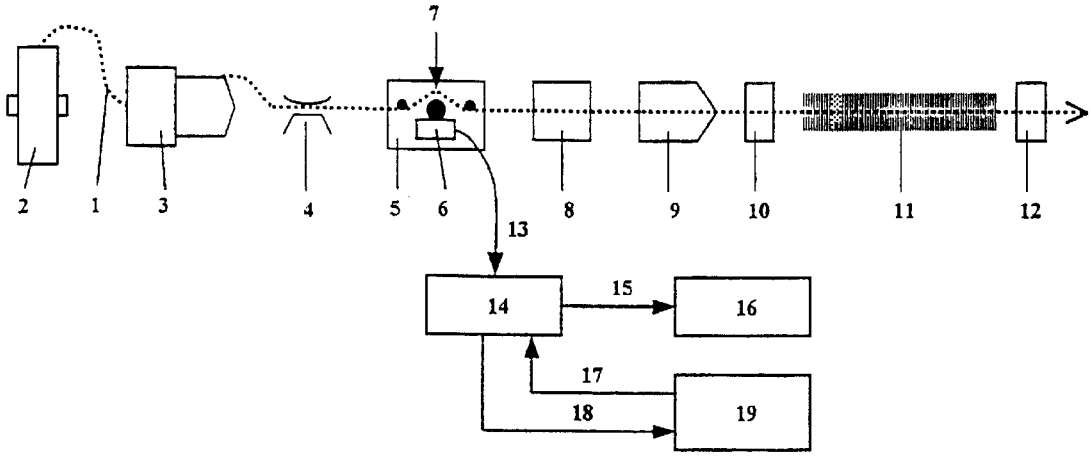
FIG. 1 shows a schematic illustration of the measuring arrangement for carrying out the method according to the invention.

The principle of the measuring arrangement is schematically shown in FIG. 1. A weft yarn feeder 3 withdraws a weft yarn 1 from a bobbin 2. The weft yarn passes through a yarn brake 4 and through a yarn force sensor 5 according to the invention. The force acting in the weft yarn is measured in known fashion by deflecting the yarn and by converting the reaction force 7 of the yarn by a pressure sensitive element 6 into an electrical signal 13. Further downstream, the weft yarn is passing the so-called colour selector which is responsible for the operational co-ordination of different weft yarns for the respective weft insertion. The weft insertion is actively carried out by element 9 which accelerates the yarn and drives it further.

The element 9 may be of different design depending on the kind of weaving machine. It may be a projectile or a gripper or may be the main nozzle and the subsequent relay nozzles of an air jet weaving machine, or the injector of a water jet weaving machine. During weft insertion the weft yarn passes through the weaving shed 11 situated between scissors 10 and 12. The force measuring element 6 can be mounted to a plate 5 provided with yarn guiding elements or may be integrated into the yarn path in the machine such that the desired force component is produced in the force measuring element 6. The element in any case is situated in the yarn path downstream of yarn brake 4, and upstream of the entrance of the weaving shed 11; and in the case of air and water weaving machines upstream of main nozzle 9.

The electric signal 13 output by yarn force sensor 5 is electronically amplified in evaluation unit 14, is evaluated and is brought as signal 15 into an indicator 16 informing the operator about the cycle of the weft insertion and of disturbances and corrections. For this purpose the evaluation unit 14 is connected via a data line 17 with the control 19 of the machine. From control 19 evaluation unit 14 is supplied with time signals of further machine functions participating at the weft insertion, e.g. the momentary angular position of the main shaft of the machine. Said machine control also receives monitoring signals of the yarn force evaluation unit 14 via data line 18, e.g. to immediately stop in case of a yarn breakage during the weft insertion or to activate a machine related alarm arrangement in case of a disturbance needing interference by the operator.

Figure 2:
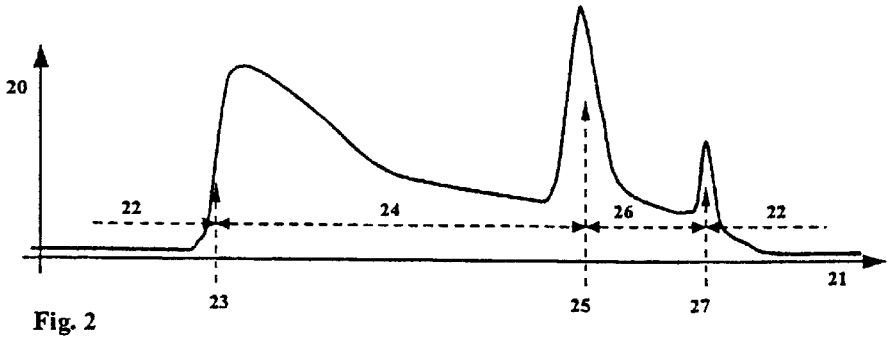
FIG. 2 is a graph illustrating the yarn force signal.

The shape of signal 13 is shown in its timewise development in FIG. 2 for the example of an air jet weaving machine. The diagram shows the yarn pull at its vertical axis 20 and time at the horizontal axis 21. In section 22 outside of the initial weft insertion process there is no tension in the yarn. At point in time 23 the yarn is accelerated and enters the weaving shed. This results in a rapid increase of the yarn force. During time duration 24 the yarn is running through the weaving shed. At point in time 25 the yarn as measured in its length by feeder or prewinding device 3 is stopped leading to a typical force peak. Then the yarn remains stretched during time duration 26 until at point in time 27 the reed is beating up the yarn against the fabric and is again generating a characteristic force peak. Subsequently the yarn is cut at both sides by scissors 10 and 12. The yarn force drops and the cycle starts again.

Figure 3:
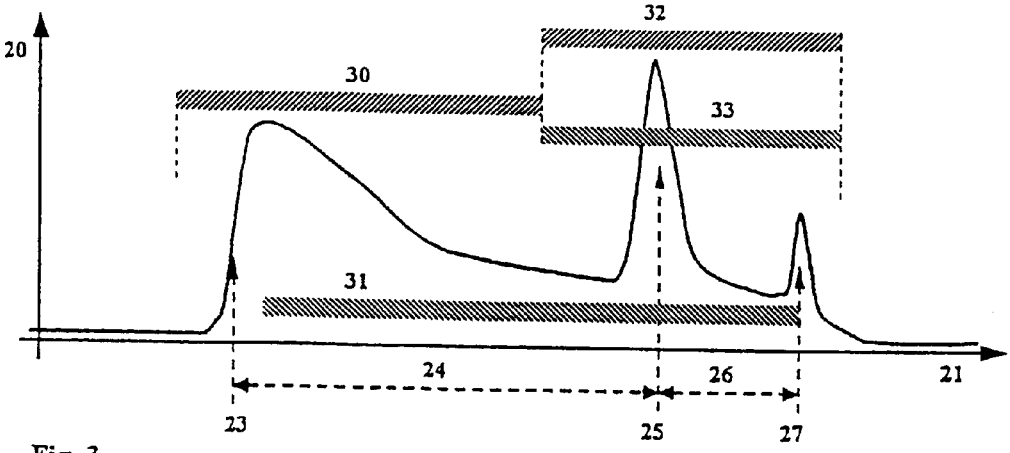
FIG. 3 is a graph similar to FIG. 2 illustrating the yarn force signal without any disturbances; and a method for monitoring a weft insertion.

In the following, different possibilities for evaluating the signals will be described. FIG. 3 shows the force signal for a weft insertion without any disturbance analogously to FIG. 2. Monitoring such a signal development for a predetermined time duration belongs to known prior art of digital signal processing. The signal generated for this purpose by the sensor in analogous form is digitized in time intervals of a maximum of 10 ms, preferably less than 1 ms, and is compared with limit values associated with the respective time steps. The limit values can be set by the user of the machine on the basis of yarn data or experience values, or may even be determined and set during operation by the evaluation device according to the principle of an adaptive control. Also, a so-called teach-in by the operator is provided. Finally, an average value is formed for each time step on the basis of the determined cycle of the yarn force learned from operation experience to set a target pattern on the basis of the average values. Each single weft insertion is compared with the target pattern. As soon as a predetermined tolerance is exceeded an alarm is given or the machine is stopped. A decisive advantage is that the occurred force development resulting in a stop subsequently is available for a diagnosis by the operator and that the force development can be compared with the picture offered by the machine itself.

Figure 4:
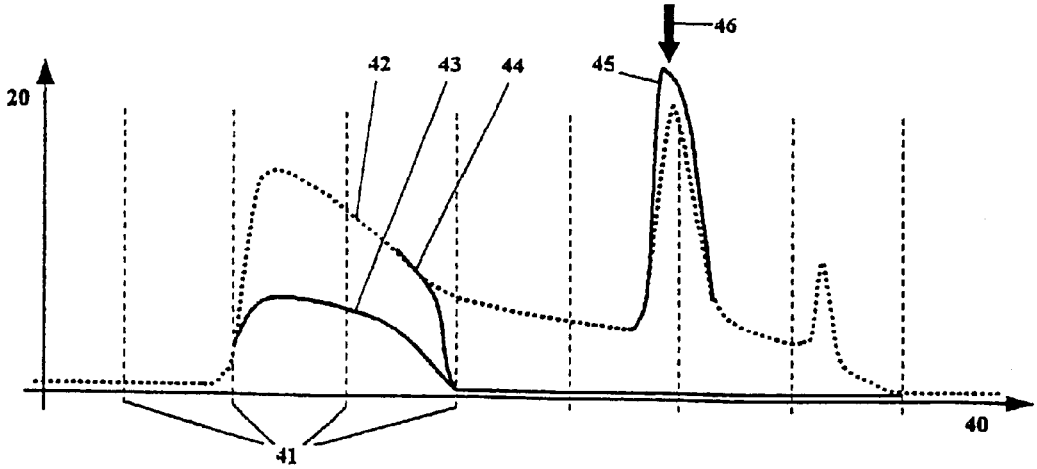
FIG. 4 is a graph illustrating the principles for the optimization of the weft insertion.

A limit value may be, as shown in FIG. 3, e.g. a maximum pulling force 30 during insertion of the yarn. The pulling force is limited to a determined value due to the simultaneous acceleration of the yarn which value normally is lower than the value occurring when the yarn is stopped. During the entire weft insertion, a minimum yarn force 31 has to be monitored to immediately detect a yarn breakage. Finally, the peak load of the yarn when stopped at 32 is to be monitored. The magnitude of the force peak at the other side is a confirming feature for a successfully carried out weft insertion and again is monitored in connection with a minimum value 32. Also the timewise developments, given by the positions of force peaks 23, 25, and 27, are to be monitored in an analogous fashion by the control. The function here is not shown in further detail since it is carried out like the nowadays conventional monitoring of the arrival of the yarn tip by an optical sensor at the location of scissors 12 (FIG. 1). FIG. 4 indicates how the method is used to optimize the weft insertion. The yarn force is shown at the vertical axis 20. Horizontal axis 40 is not to be seen as a time axis but is subdivided into sections 41 of the weaving cycle which sections correspond to a determined number of rotation angle degrees of the main shaft of the weaving machine. From this it can be seen how determined effects occurring during the weft insertion are associated with the control functions of the weaving machine. This is decisive for the practical operation during optimization of the weft insertion, because the operator has to decide which interferences might be needed, or in an automatic optimization method needed and useful interferences have to be displayed for the operator. The correct force development 42 is determined numerically by forming average values of a series of insertion cycles and is displayed in colours in the screen (in this case dotted). Deviations of particular cycles resulting in a stopping of the machine, like e.g. weft insertions 43 or 44 stopped by yarn breakages, are displayed in a different, clearly visible way. In this case an automatic force diagnosis also indicates the kind of fault as this is nowadays done in a simple way by alphanumerical displays at the weaving machines, however, only to a limited extent, e.g. just with differentiation between weft faults or warp faults.

In a similar way, the display indicates bad adjustment values, e.g. force peaks 45 which are too high for the yarn stop. Even if in this case the machine might not be stopped, the arrow 46 emphasizes the delicate condition which can be improved by changing an adjustment, e.g. decelerating the weft insertion by lowering the pressure for the relay nozzles.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A method for monitoring the cycle of a weft insertion into a weaving machine, said method comprising:

providing a signal generating piezo-resistive or piezo-electrical yarn force sensor connected to an evaluation unit;

actuating the sensor by deflection with a weft yarn and generating a signal with the sensor;

comparing the signal to a target pattern and deriving at least a diagnosis from the comparison;

continuously measuring the yarn force within the weft insertion and outside of the weft insertion with the sensor having a limit frequency of at least 1 kHz and with a sampling rate of at least 100 Hz with the signal which analogously corresponds to the yarn force;

evaluating the signal in a digitized manner in time intervals; and changing a weaving machine control function adjustment optimizing the weft insertion on the basis of the measured yarn force and/or initiating a weaving machine control function optimizing the weft insertion on the basis of the measured yarn force.

2. The method of claim 1 wherein said step of continuously measuring includes measuring the yarn force with a piezo-resistive crystal in connection with a direct voltage amplifier having a limit frequency of at least 1 kHz.

3. The method of claim 1 wherein said step of continuously measuring includes measuring the yarn force with a piezo-resistive crystal in connection with a direct voltage amplifier having a limit frequency of more than 5 kHz.

4. The method of claim 1 wherein said step of continuously measuring includes measuring the yarn force with a piezo-electrical crystal in connection with a charge amplifier.

5. The method of claim 1 including evaluating the signal in relation to rotation angle positions of a main shaft of the weaving machine associated with predetermined portions of a weaving cycle.

6. The method of claim 1 including monitoring the yarn force in view of a minimum limit value in predetermined portions of a weaving cycle related to time or to a rotation angle of a main shaft of the weaving machine, and initiating a predetermined function of the weaving machine if the yarn force drops below the minimum limit value.

7. The method of claim 1 including monitoring the yarn force in view of a maximum limit value during a predetermined portion of a weaving cycle related to time or to a rotation angle of a main shaft of the weaving machine, and initiating a predetermined function of the weaving machine if the yarn force exceeds the maximum limit value.

8. The method of claim 1 including monitoring a magnitude of predetermined force peaks of the yarn force during a weft insertion cycle with predetermined tolerance fields related to time or to a rotation angle of a main shaft of the weaving machine, and initiating a predetermined function of the weaving machine if the magnitude is outside the tolerance field.

9. The method of claim 1 including forming a target pattern picture based upon the development of the yarn force during a selected phase of the weft insertion, monitoring the yarn force in view of maintaining the target pattern picture, and initiating a predetermined function of the weaving machine in the event of a deviation from the target pattern picture.

* * * * *